US011664584B2

(12) United States Patent
Yun

(10) Patent No.: US 11,664,584 B2
(45) Date of Patent: May 30, 2023

(54) MONOPOLE ANTENNA ASSEMBLY

(71) Applicant: TE Connectivity Services GmbH, Schaffhausen (CH)

(72) Inventor: Xing Yun, Oxford, MI (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 144 days.

(21) Appl. No.: 16/944,504

(22) Filed: Jul. 31, 2020

(65) Prior Publication Data

US 2022/0037767 A1 Feb. 3, 2022

(51) Int. Cl.

| | |
|---|---|
| ***H01Q 1/48*** | (2006.01) |
| ***H01Q 1/32*** | (2006.01) |
| ***H01Q 1/24*** | (2006.01) |
| ***H01Q 5/50*** | (2015.01) |

(52) U.S. Cl.

CPC ..... *H01Q 1/246* (2013.01); *H01Q 1/48* (2013.01); *H01Q 5/50* (2015.01); *H01Q 1/3275* (2013.01)

(58) Field of Classification Search

CPC .. H01Q 9/30; H01Q 9/40; H01Q 1/48; H01Q 1/1207; H01Q 9/32; H01Q 1/3275; H01R 4/18; H01R 4/20; H01P 5/085

See application file for complete search history.

(56) References Cited

U.S. PATENT DOCUMENTS

| | | | | |
|---|---|---|---|---|
| 2009/0058759 | A1* | 3/2009 | Morikawa | H01P 5/085 343/906 |
| 2011/0273339 | A1* | 11/2011 | Hornung | H01R 9/0515 343/702 |
| 2015/0109183 | A1* | 4/2015 | Smith | H01Q 9/32 174/6 |
| 2018/0138595 | A1* | 5/2018 | Nysen | H01Q 1/38 |

FOREIGN PATENT DOCUMENTS

| | | | | |
|---|---|---|---|---|
| DE | 3826777 A1 * | 8/1990 | | H01Q 5/40 |
| JP | 3147014 B2 * | 3/2001 | | H01P 1/06 |

* cited by examiner

*Primary Examiner* — Ricardo I Magallanes

(57) ABSTRACT

A monopole antenna assembly includes a cable having a cable inner conductor and a cable outer conductor. The monopole antenna assembly includes an antenna base including a ground plane. The ground plane is electrically connected to the cable outer conductor using a compression connection. The monopole antenna assembly includes a monopole radiator having a radiating element and a cable connection element extending from the radiating element. The crimp element is coupled to the cable inner conductor at a compression connection.

24 Claims, 7 Drawing Sheets

MONOPOLE ANTENNA ASSEMBLY

BACKGROUND OF THE INVENTION

The subject matter herein relates generally to monopole antenna assemblies.

Monopole antennas are widely used in many applications. A typical application of a monopole antenna is to use a vertical metal stub or vertical printed circuit board as a radiator for the monopole antenna, which is soldered on a horizontal printed circuit board. The horizontal printed circuit board is the ground plane of the monopole antenna. A coaxial cable is soldered to the horizontal printed circuit board for signal connection. The inner conductor of the coaxial cable is soldered to the printed circuit board signal trace connecting to the vertical radiator and the outer conductor of the cable is soldered to the printed circuit board ground plane. The soldering processes are typically manual because of the complexity of the structure. The manual soldering process is time-consuming and expensive when production volume is high. The quality of solder joints is inconsistent when manual soldering is performed. Additionally, electromagnetic wave energy loss in the dielectric material of the printed circuit boards is significant in high frequency applications, such as applications above 5 GHz, such as V2X, WiFi 6, 5G Ultra Wide Band (UWB), remote keyless entry, and the like. Antenna efficiency and antenna gain are reduced and the transmit and receive signal strength are negatively impacted when using printed circuit boards.

A need remains for cost effective and reliable monopole antennas.

BRIEF DESCRIPTION OF THE INVENTION

In one embodiment, a monopole antenna assembly is provided. The monopole antenna assembly includes a cable having a cable inner conductor and a cable outer conductor. The monopole antenna assembly includes an antenna base including a ground plane. The ground plane is electrically connected to the cable outer conductor using a compression connection. The monopole antenna assembly includes a monopole radiator having a radiating element and a cable connection element extending from the radiating element. The crimp element is coupled to the cable inner conductor at a compression connection.

In another embodiment, a monopole antenna assembly is provided. The monopole antenna assembly includes a cable having a cable inner conductor and a cable outer conductor. The monopole antenna assembly includes an antenna base including a ground plane. The ground plane is electrically connected to the cable outer conductor. The ground plane includes an opening between an upper surface and a lower surface of the ground plane. The monopole antenna assembly includes a monopole radiator having a radiating element and a crimp element extending from the radiating element. The radiating element passes through the opening above the upper surface. The crimp element is located below the lower surface and is crimped to the cable inner conductor. The monopole antenna assembly includes a monopole insulator coupled to the radiating element. The monopole insulator is received in the opening to isolate the monopole radiator from the ground plane.

In another embodiment, a monopole antenna assembly is provided. The monopole antenna assembly includes a cable having a cable inner conductor and a cable outer conductor. The monopole antenna assembly includes an antenna base including a ground plane. The ground plane is electrically connected to the cable outer conductor using a solderless connection. The monopole antenna assembly includes a monopole radiator having a radiating element and a cable connection element extending from the radiating element. The cable connection element is coupled to the cable inner conductor at a compression connection. The radiating element includes a pole and a multi-band radiator panel. The pole extends from the crimp element. The pole is electrically coupled to the multi-band radiator panel using a compression connection.

DETAILED DESCRIPTION OF THE INVENTION

Figure 1:
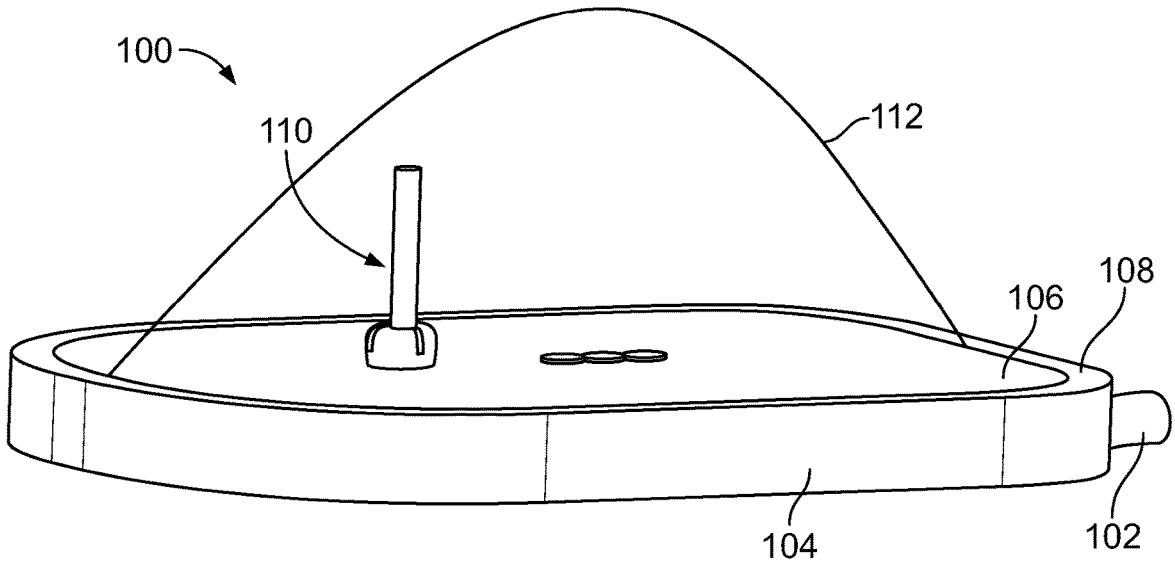
FIG. 1 is a perspective view of a monopole antenna assembly in accordance with an exemplary embodiment.

FIG. 1 is a perspective view of a monopole antenna assembly 100 in accordance with an exemplary embodiment. The monopole antenna assembly 100 may be a single band monopole antenna in various embodiments. The monopole antenna assembly 100 may be a directional rooftop V2X antenna in various embodiments. The monopole antenna assembly 100 includes a cable 102 extending to an antenna base 104. The antenna base 104 includes a ground plane 106 electrically connected to the cable 102. In various embodiments, the antenna base 104 may include a ground plane holder 108 holding the ground plane 106. The monopole antenna assembly 100 includes a monopole radiator 110 coupled to the antenna base 104. The monopole radiator 110 is electrically connected to the cable 102 and forms the transmitting antenna element or receiving antenna element of the monopole antenna assembly 100. In various embodiments, the monopole antenna assembly 100 includes an antenna cover 112 (shown in phantom) to cover the components of the monopole antenna assembly 100.

In an exemplary embodiment, the monopole radiator 110 and the ground plane 106 are electrically connected to the cable 102 using solderless connections. The solderless connections reduce manufacturing cost and increase manufacturing speed compared to soldered connections. The monopole antenna assembly 100 may be manufactured using automated processes to avoid human impact on quality of the electrical connections between the cable 102 and both the monopole radiator 110 and the ground plane 106.

In an exemplary embodiment, the ground plane 106 is a metal sheet, which may be held by the ground plane holder 108. The ground plane holder 108 may be a plastic component, such as a molded plastic component having a pocket that receives the ground plane 106. The cable 102 may extend into the ground plane holder 108, such as into a cavity at a bottom of the ground plane holder 108. In alternative embodiments, the antenna base 104 may be provided without the ground plane holder 108. Rather, the ground plane 106 may be mounted to another structure, such as within a vehicle or an electrical device. In alternative embodiments, the antenna base 104 may include a printed circuit board forming the ground plane 106. However, the use of the metal sheet may reduce electromagnetic wave loss typical in printed circuit boards, which is more significant in higher frequency applications. In various embodiments, the metal sheet may have increased radiation efficiency compared to the printed circuit board.

Figure 2:
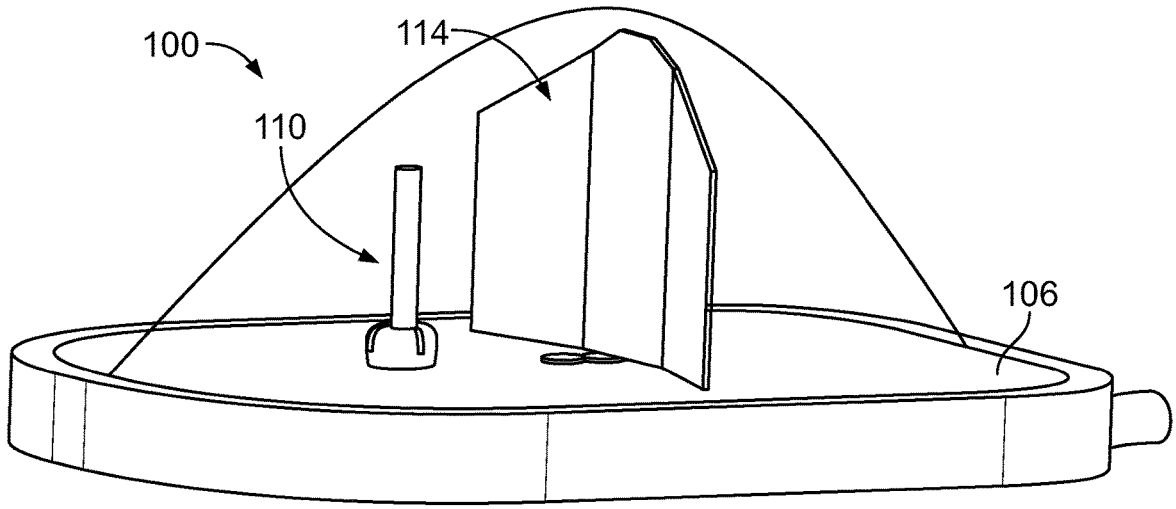
FIG. 2 is a perspective view of the monopole antenna assembly showing a reflector in accordance with an exemplary embodiment.

FIG. 2 is a perspective view of the monopole antenna assembly 100 in accordance with an exemplary embodiment. In the illustrated embodiment, the monopole antenna assembly 100 includes a reflector 114 coupled to the ground plane 106. The reflector 114 controls the directionality of the antenna. In an exemplary embodiment, the reflector 114 is coupled to the ground plane 106 at a solderless connection. For example, the reflector 114 may be press-fit into the ground plane 106 to create a mechanical and electrical connection between the reflector 114 and the ground plane 106. In the illustrated embodiment, the reflector 114 is oriented perpendicular to the ground plane 106 and is spaced apart from the monopole radiator 110. For example, the ground plane 106 may be oriented horizontally and the monopole radiator 110 and the reflector 114 may be oriented vertically.

Figure 3:
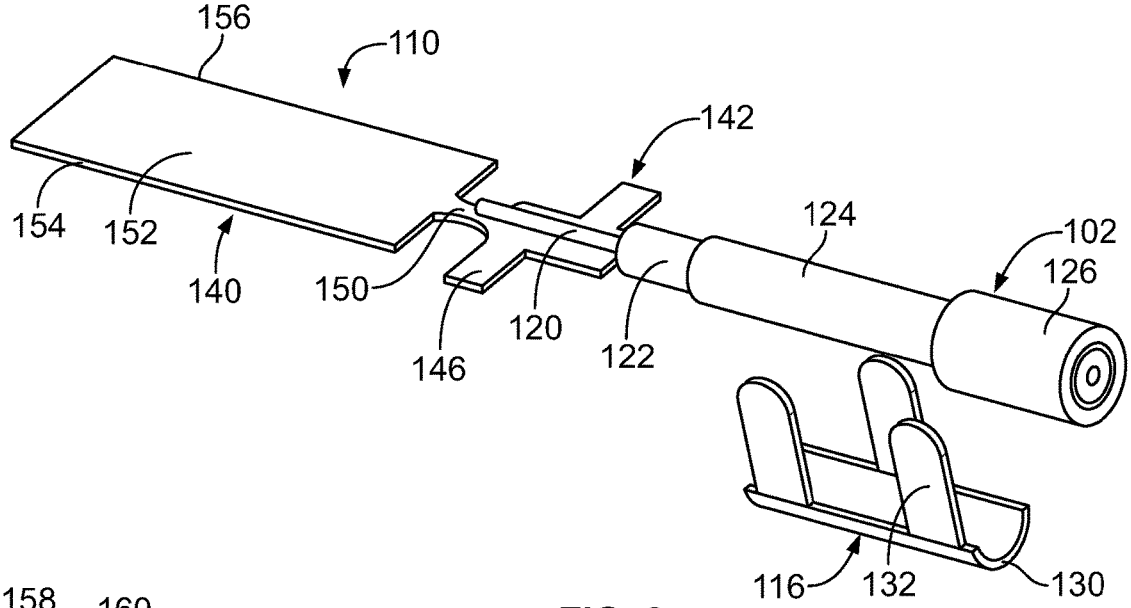
FIG. 3 is an exploded view of a portion of the monopole antenna assembly showing a monopole radiator.
Figure 4:
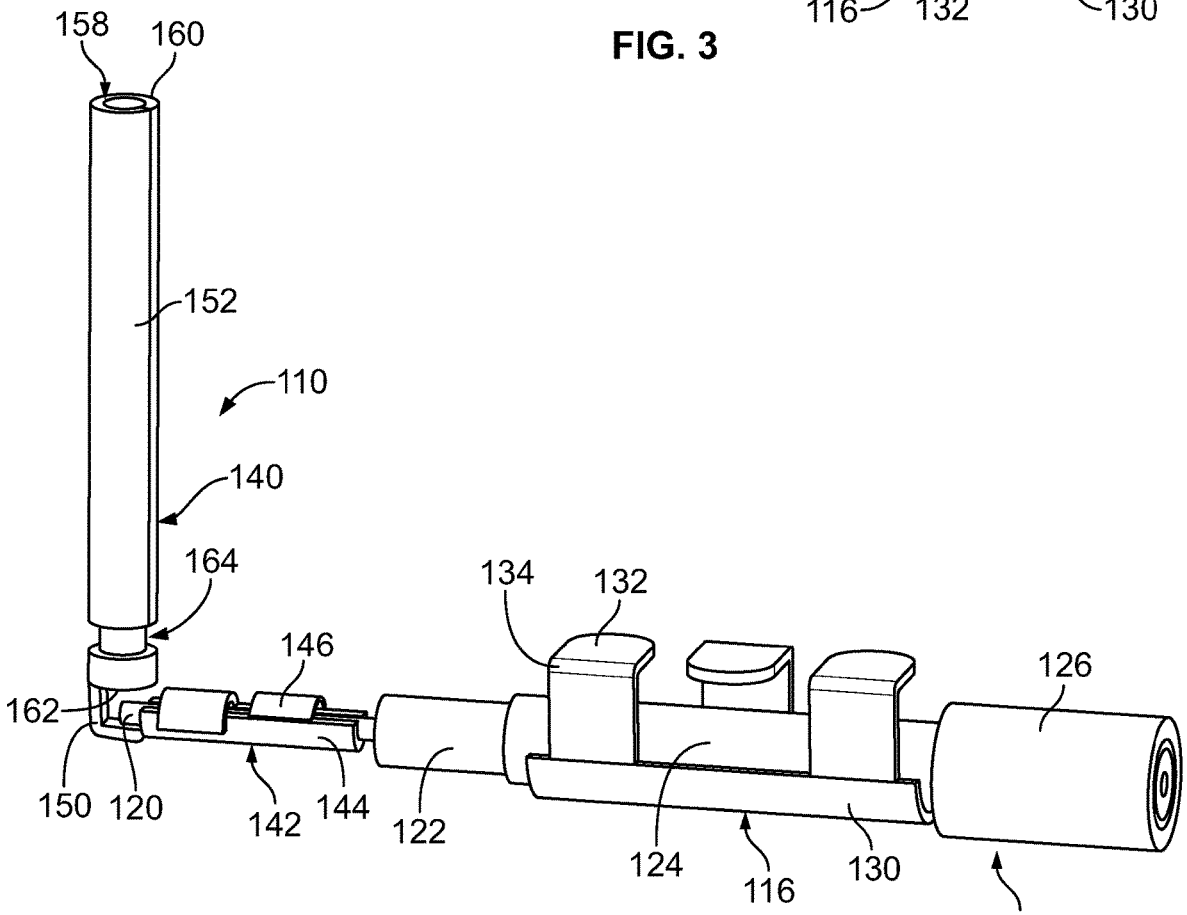
FIG. 4 is an assembled view of a portion of the monopole antenna assembly showing the monopole radiator in accordance with an exemplary embodiment.

FIG. 3 is an exploded view of a portion of the monopole antenna assembly 100 showing the monopole radiator 110 in an uninformed state relative to the cable 102. FIG. 4 is an assembled view of a portion of the monopole antenna assembly 100 showing the monopole radiator 110 in a formed state coupled to the cable 102. FIGS. 3 and 4 illustrate a ground lug 116 used to electrically connect the cable 102 to the ground plane 106 (shown in FIG. 1).

The cable 102 includes a cable inner conductor 120, a cable insulator 122, a cable outer conductor 124, and a cable jacket 126. The cable insulator 122 is located between the cable inner conductor 120 and the cable outer conductor 124. The cable jacket 126 surrounds the cable outer conductor 124. During manufacture, portions of the cable inner conductor 120 and the cable outer conductor 124 are exposed for electrical connection to the monopole radiator 110 and the ground lug 116, respectively. In an exemplary embodiment, the monopole radiator 110 is crimped to the cable inner conductor 120. In an exemplary embodiment, the ground lug 116 is crimped to the cable outer conductor 124.

The ground lug 116 includes a main body 130 and ground tabs 132 extending from the main body 130. The main body 130 is configured to be electrically connected to the cable outer conductor 124 at a solderless connection. For example, the main body 130 may be coupled to the cable outer conductor 124 at a compression connection in various embodiments. The compression connection uses compression of one or both conductive elements to form a mechanical and electrical connection between the elements. In an exemplary embodiment, the main body 130 is crimped to the cable outer conductor 124. In the illustrated embodiment, the main body 130 is formed to wrap around the cable outer conductor 124. For example, the main body 130 may be partially barrel shaped. In the illustrated embodiment, the top of the barrel is open to receive the cable 102 therein. In alternative embodiments, the main body 130 may form a closed barrel wrap entirely around the cable 102. For example, the cable 102 may be loaded through an end of the barrel shaped main body 130. In the illustrated embodiment, the ground tabs 132 extend from a top of the main body 130 the ground tabs 132 are configured to be electrically connected to the ground plane 106. In an exemplary embodiment, the ground tabs 132 are configured to be electrically connected to the ground plane 106 at a solderless connection. For example, the ground tabs 132 may be crimped to the ground plane 106. In various embodiments, the ground tabs 132 may be coupled to the ground plane 106 by a clipping or stapling type of connection. For example, the ground tabs 132 may be folded over at bends 134 to mechanically and electrically connect to the ground plane 106. For example, distal ends of the ground tabs 132 may pass through the ground plane 106, after which the ground tabs 132 are bent over and pressed against the ground plane 106. When the ground tabs 132 are bent over, the ground plane 106 and the cable outer conductor 124 of the cable 102 may be compressed between the main body 130 and the ground tabs 132. Other types of solderless mechanical and electrical connections may be made between the ground lug 116 and the ground plane 106.

The monopole radiator 110 includes a radiating element 140 and a cable connection element 142 extending from the radiating element 140. The monopole radiator 110 is a stamped and formed component. For example, the monopole radiator 110 may be stamped from a metal sheet to define a flat piece (FIG. 3) for the radiating element 140 and the cable connection element 142. The radiating element 140 and the cable connection element 142 may then be formed by bending, folding, rolling and the like to form the finished part (FIG. 4). The radiating element 140 forms the transmitting antenna or the receiving antenna of the monopole antenna assembly 100. The cable connection element 142 forms the electrical connection with the cable inner conductor 120. In the illustrated embodiment, the cable connection element 142 is a crimp element and may be referred to hereinafter as a crimp element 142. However, the cable connection element 142 may be other types of connecting elements in alternative embodiments, such as a compressible spring beam. The cable connection element 142 is coupled to the cable 102 at a solderless connection in an exemplary embodiment. For example, the cable connection element 142 is coupled to the cable 102 at a compression connection using compression of one or both elements to form a mechanical and electrical connection between the elements.

In an exemplary embodiment, the crimp element 142 includes a crimp barrel 144 that receives the cable inner conductor 120 and crimp tabs 146 letter wrapped around the cable inner conductor 120. During a crimping process, the crimp barrel 144 and the crimp tabs 146 are wrapped around the cable inner conductor 120 to mechanically and electrically connect the monopole radiator 110 to the cable inner conductor 120. The crimp connection between the crimp element 142 and the cable inner conductor 120 is a solderless connection.

The radiating element 140 includes a neck 150 between the crimp element 142 and a main body 152 of the radiating element 140. In an exemplary embodiment, the main body 152 is formed by rolling first and second edges 154, 156 of the main body 152 into a tubular shape. The main body 152 forms a cylindrical pole 158 when formed. The pole 158 extends between a top 160 and a bottom 162. The neck 150 extends from the bottom 162 to the crimp element 142. In an exemplary embodiment, the neck 150 is bent at a right angle such that the pole 158 is oriented perpendicular to the crimp element 142 and the cable axis of the cable 102. However, the pole 158 may be parallel to the crimp element 142 and the cable axis of the cable 102 in alternative embodiments. In an exemplary embodiment, the pole 158 is deformed during the forming process to include a deformity 164. In the illustrated embodiment, the deformity 164 is a circumferential channel formed around the pole 158 proximate to the bottom 162. Other types of deformities may be provided in alternative embodiments, such as dimples. The deformity 164 is configured to receive an insulator used to electrically isolate the radiating element 140 from the ground plane 106, as described in further detail below. The radiating element 140 may have other sizes or shapes in alternative embodiments. For example, the radiating element 140 may be flat rather than cylindrical in alternative embodiments.

Figure 5:
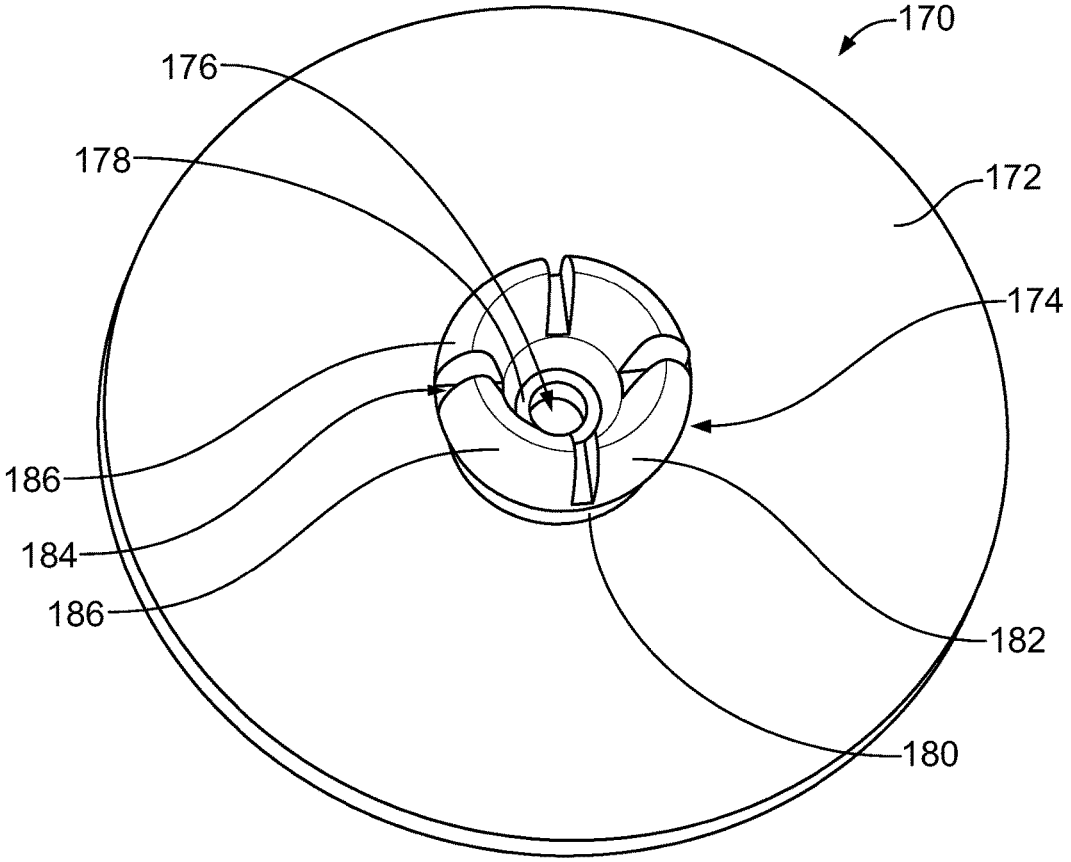
FIG. 5 is a top perspective view of a monopole insulator of the monopole antenna assembly in accordance with an exemplary embodiment.

FIG. 5 is a top perspective view of a monopole insulator 170 in accordance with an exemplary embodiment. The monopole insulator 170 is used to electrically isolate the monopole radiator 110 from the ground plane 106 (both shown in FIG. 1). The monopole insulator 170 may be manufactured from a rubber material or other insulating material. The monopole insulator 170 includes a flange 172 and a bulb 174 extending from the flange 172. In the illustrated embodiment, the flange 172 is disc shaped. The flange 172 may have other shapes in alternative embodiments. The bulb 174 has a central opening 176 that receives the monopole radiator 110. In an exemplary embodiment, a carrier portion 178 extends into the central opening 176. The carrier portion 178 is configured to receive the monopole radiator 110. For example, the carrier portion 178 may be received in the deformity 164 (shown in FIG. 4) to position the monopole radiator 110 relative to the monopole insulator 170.

The bulb 174 includes a neck 180 and a head 182 above the neck 180. The head 182 is wider than the neck 180. The head 182 may have a generally outer profile. In an exemplary embodiment, the bulb 174 includes slots 184 formed in the head 182. The slots 184 may extend radially through the head 182. The slots 184 separate the head 182 into head sections 186. The head sections 186 may be movable relative to each other, such as to contract the head 182 as the head 182 is loaded through an opening in the ground plane 106. After the head 182 passes through the opening in the ground plane 106, the head sections 186 expand outward to retain the monopole insulator 170 on the ground plane 106.

Figure 6:
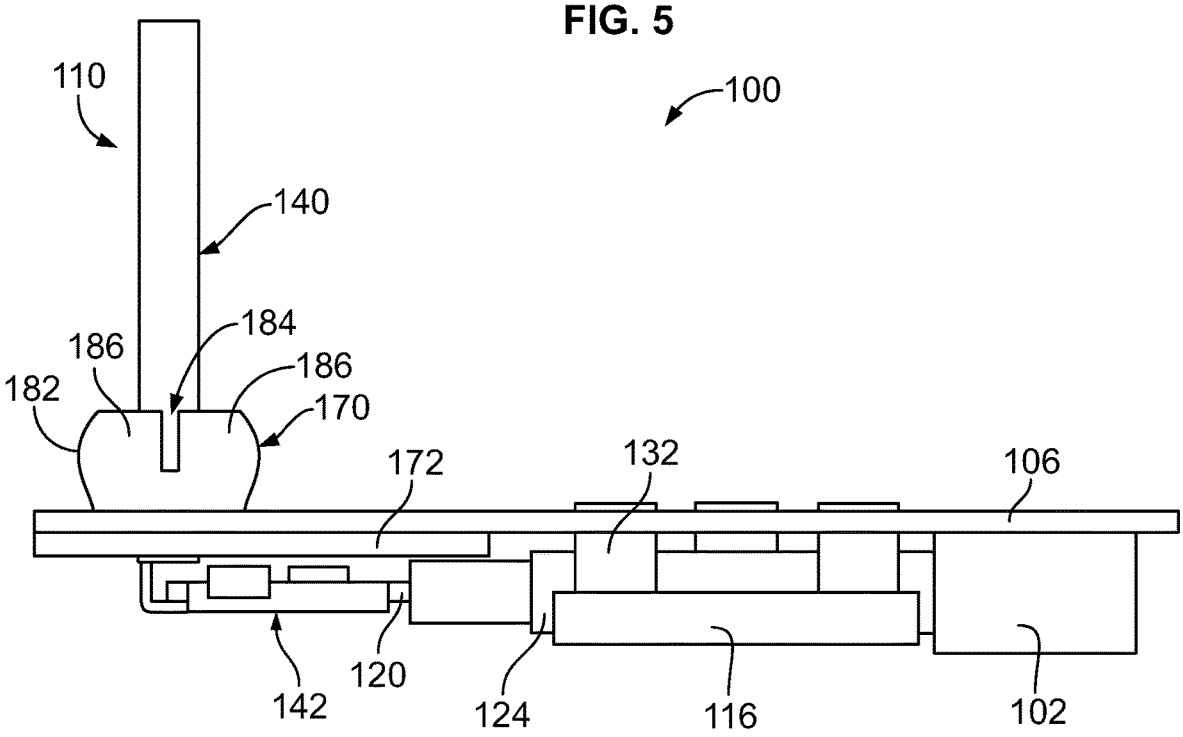
FIG. 6 is a side view of a portion of the monopole antenna assembly in accordance with an exemplary embodiment.
Figure 7:
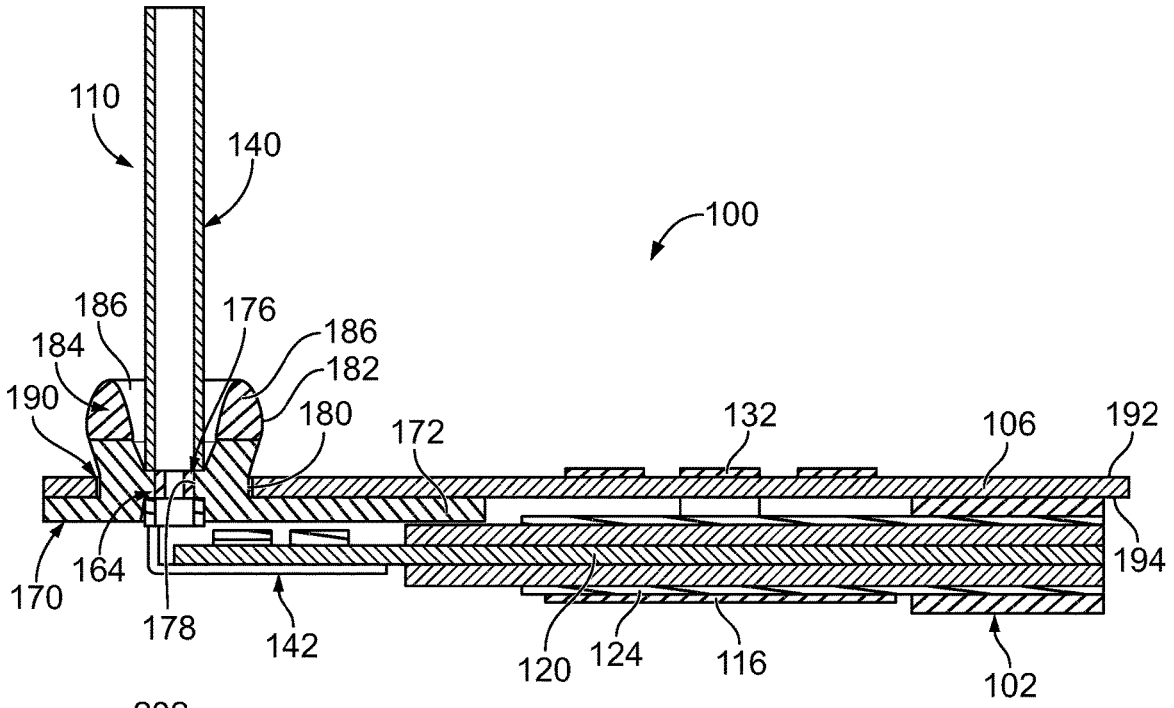
FIG. 7 is a cross-sectional view of a portion of the monopole assembly in accordance with an exemplary embodiment.

FIG. 6 is a side view of a portion of the monopole antenna assembly 100 in accordance with an exemplary embodiment. FIG. 7 is a cross-sectional view of a portion of the monopole assembly 100 in accordance with an exemplary embodiment. FIGS. 6 and 7 illustrate the monopole radiator 110 and the cable 102 coupled to the ground plane 106. The monopole insulator 170 passes through an opening 190 in the ground plane 106 between an upper surface 192 and a lower surface 194 of the ground plane 106. The cable 102 is located below the lower surface 194. The radiating element 140 of the monopole radiator 110 passes through the opening 190 and is located above the upper surface 192 of the ground plane 106. The monopole insulator 170 electrically isolates the monopole radiator 110 from the ground plane 106.

During assembly, the radiating element 140 of the monopole radiator 110 is loaded through the central opening 176 of the monopole insulator 170. The carrier portion 178 is received in the deformity 164 to position the radiating element 140 relative to the monopole insulator 170. The monopole insulator 170 is coupled to the ground plane 106 by loading the head 182 through an opening 190 in the ground plane 106. The head 182 has a diameter larger than a diameter of the opening 190 to retain the monopole insulator 170 on the ground plane 106. For example, the ground plane 106 is captured between the head 182 and the flange 172. The neck 180 is located in the opening 190. During assembly, the head 182 is compressed to fit through the opening 190. For example, the head sections 186 are squeezed inward. The slots 184 allow the head sections 186 to compress inward during loading of the head 182 through the opening 190. After the head 182 passes through the opening 190 the head sections 186 are expanded outward to retain the monopole insulator 170 on the ground plane 106. The flange 172 is located between the ground plane 106 and the crimp element 142 and the cable inner conductor 120. The flange 172 electrically isolates the crimp element 142 from the ground plane 106. The monopole insulator 170 is used to hold and position the radiating element 140 relative to the ground plane 106. For example, the monopole insulator 170 may hold the radiating element perpendicular to the ground plane 106.

In an exemplary embodiment, the ground lug 116 is used to electrically connect the cable outer conductor 124 and the ground plane 106. For example, the ground tabs 132 may be directly electrically connected to the ground plane 106. The ground tabs 132 pass through the ground plane 106 to engage the upper surface 192 of the ground plane 106. The ends of the ground tabs 132 are bent over along the upper surface 192 of the ground plane 106 to create a mechanical and electrical connection between the ground lug 116 and the ground plane 106. Optionally, the cable 102 may be pulled tightly against the ground plane 106 when the ground tabs 132 are bent over. For example, the cable outer conductor 124 may be pulled tightly against the lower surface 194 of the ground plane 106 during tightening of the ground lug 116 to the ground plane 106.

Figure 8:
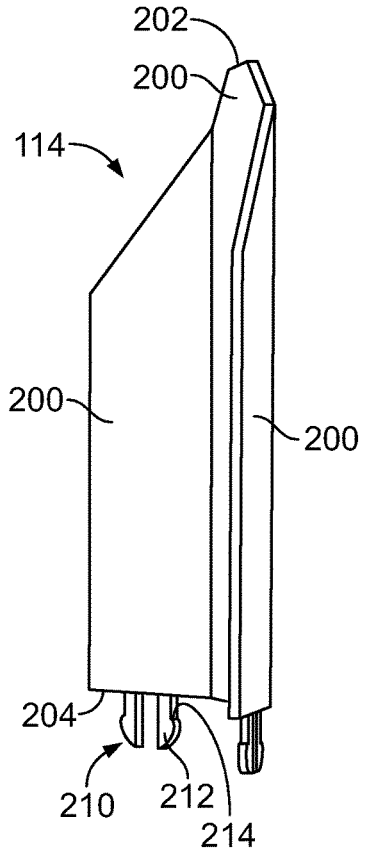
FIG. 8 is a perspective view of the reflector shown in FIG. 2 in accordance with an exemplary embodiment.

FIG. 8 is a perspective view of the reflector 114 shown in FIG. 2. The reflector 114 is a stamped and formed component. For example, the reflector 114 may be stamped from a metal sheet. The reflector 114 includes one or more reflector walls 200 extending between a top 202 and a bottom 204 of the reflector 114. In the illustrated embodiment, the reflector 114 includes three reflector walls 200 including a central reflector wall, and first and second wing reflector walls extending from the central reflector wall. The wing reflector walls are angled relative to the central reflector wall to form a cavity or pocket which may partially surround the monopole radiator 110 (shown in FIG. 2). The reflector 114 may have greater or fewer walls in alternative embodiments.

In an exemplary embodiment, the reflector 114 includes mounting tabs 210 extending from the bottom 204 of the reflector walls 200. The mounting tabs 210 are used to mechanically and electrically connect the reflector 114 to the ground plane 106 (shown in FIG. 2). In the illustrated embodiment, the mounting tabs 210 include clipping legs 212 configured to be clipped into an opening in the ground plane 106. The clipping legs 212 are deflectable. The clipping legs 212 may be formed by wedges configured to be snap coupled to the ground plane 106. In the illustrated embodiment, the clipping legs 212 are arranged in pairs. The clipping legs 212 include catch surfaces 214 configured to engage the ground plane 106 to mechanically retain the reflector 114 on the ground plane 106. Other types of mounting tabs may be used in alternative embodiments to mechanically and electrically connect the reflector 114 to the ground plane 106. For example, the mounting tabs 210 may include compliant pins, such as eye-of-the-needle pins, configured to be press-fit into openings in the ground plane 106.

Figure 9:
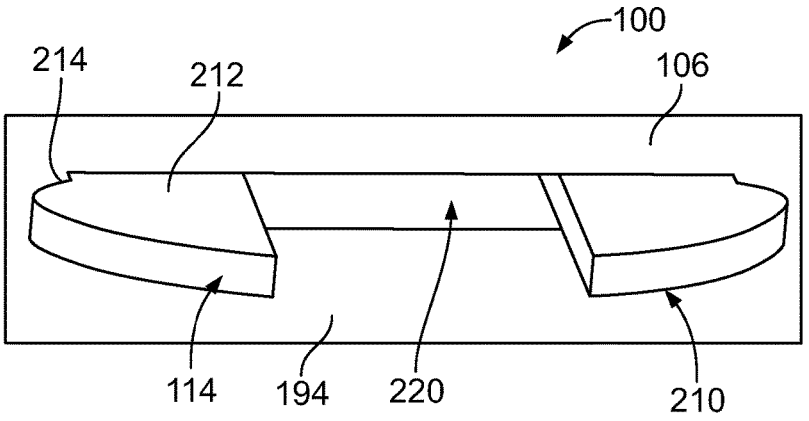
FIG. 9 is a bottom perspective view of a portion of the monopole antenna assembly showing mounting tabs of the reflector in accordance with an exemplary embodiment.

FIG. 9 is a bottom perspective view of a portion of the monopole antenna assembly 100 showing the mounting tabs 210 of the reflector 114 coupled to the ground plane 106. The ground plane 106 includes an opening 220 that receives the mounting tabs 210. In the illustrated embodiment, the mounting tab 210 includes the clipping legs 212. A pair of the clipping legs 212 may be received in the opening 220. The clipping legs 212 may be squeezed together as the clipping legs 212 are loaded through the ground plane 106. After the catch surfaces 214 pass through the opening 220 the clipping legs 212 snap outward such that the catch surfaces 214 engage the lower surface 194 of the ground plane 106 to retain the reflector 114 on the ground plane 106.

Figure 10:
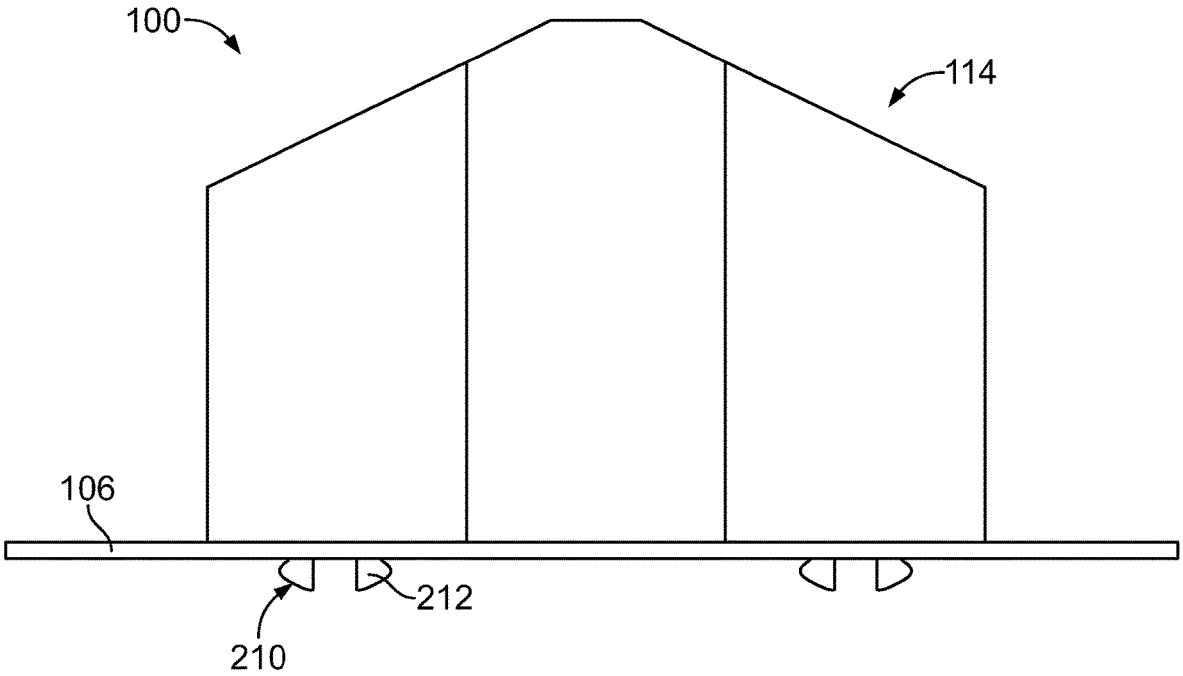
FIG. 10 is a side view of a portion of the monopole antenna assembly showing the reflector coupled to the ground plane in accordance with an exemplary embodiment.

FIG. 10 is a side view of a portion of the monopole antenna assembly 100 showing the reflector 114 coupled to the ground plane 106. The mounting tabs 210 pass through the ground plane 106 to mechanically and electrically connect the reflector 114 to the ground plane 106. In the illustrated embodiment, the mounting tabs 210 include the clipping legs 212 configured to engage the ground plane 106 to mechanically and electrically connect the reflector 114 to the ground plane 106.

Figure 11:
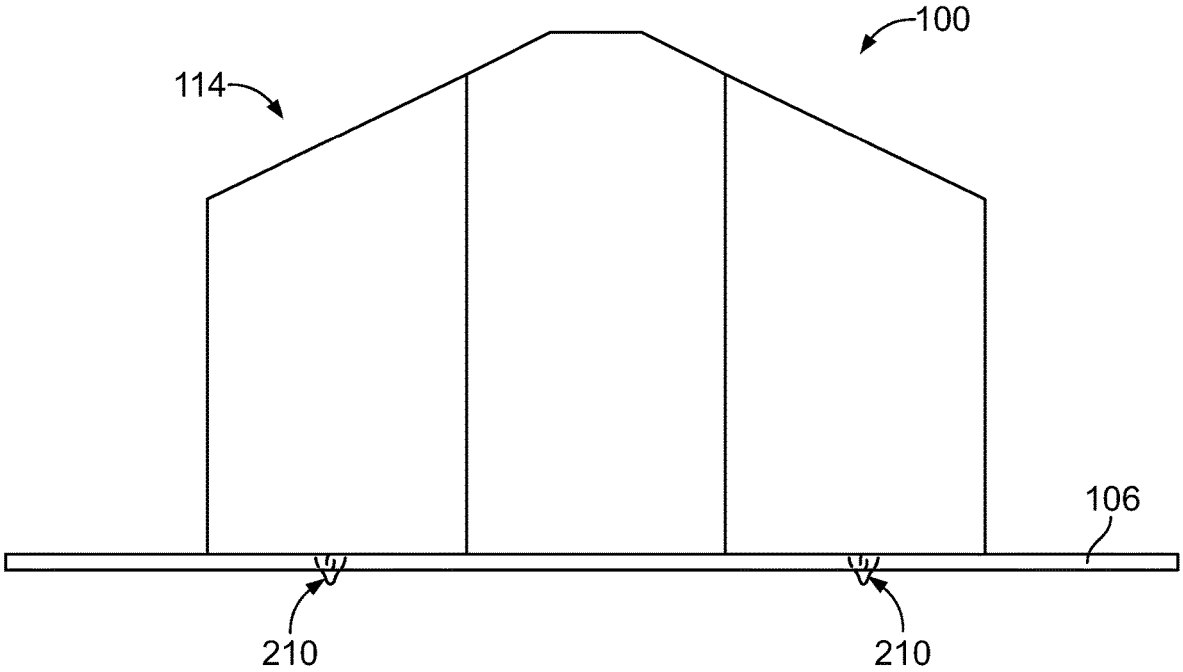
FIG. 11 is a side view of a portion of the monopole antenna assembly showing the reflector coupled to the ground plane in accordance with an exemplary embodiment.

FIG. 11 is a side view of a portion of the monopole antenna assembly 100 showing the reflector 114 coupled to the ground plane 106. In the illustrated embodiment, the mounting tabs 210 include compliant pins press-fit into the ground plane 106. The compliant pins may be eye-of-the-needle pins.

Figure 12:
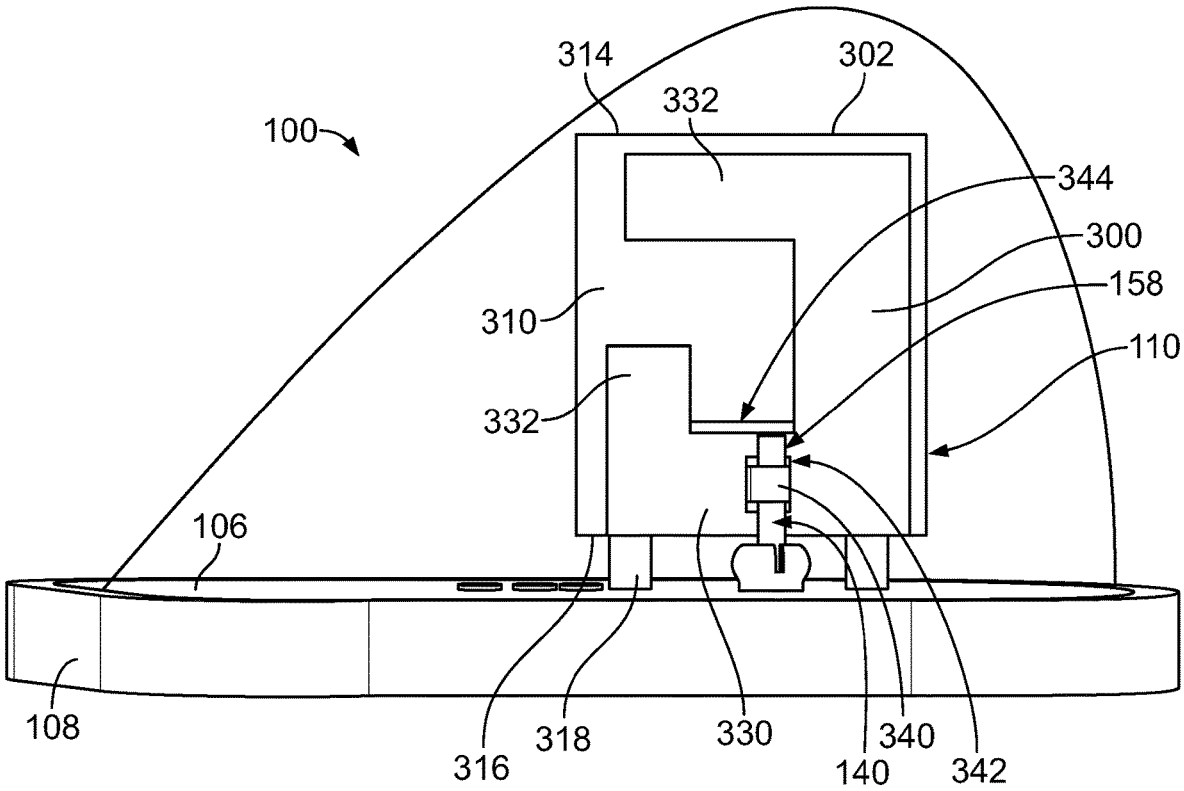
FIG. 12 is a perspective view of the monopole antenna assembly showing the monopole radiator in accordance with an exemplary embodiment.
Figure 13:
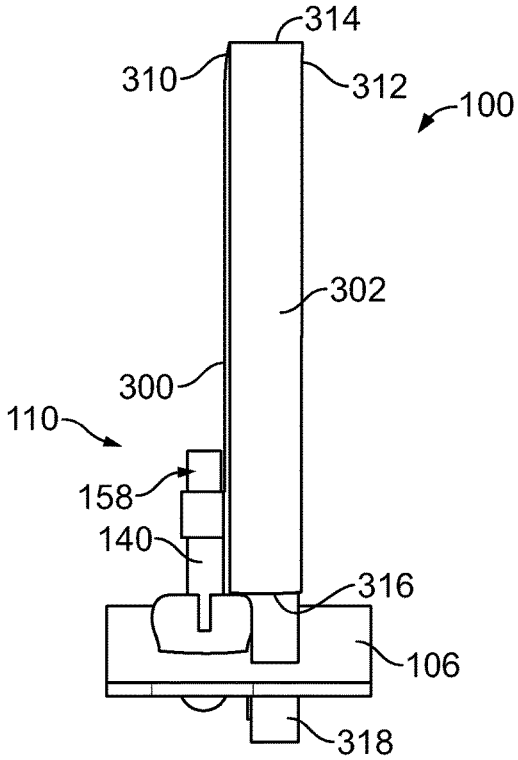
FIG. 13 is a side view of the monopole antenna assembly showing the monopole radiator in accordance with an exemplary embodiment.
Figure 14:
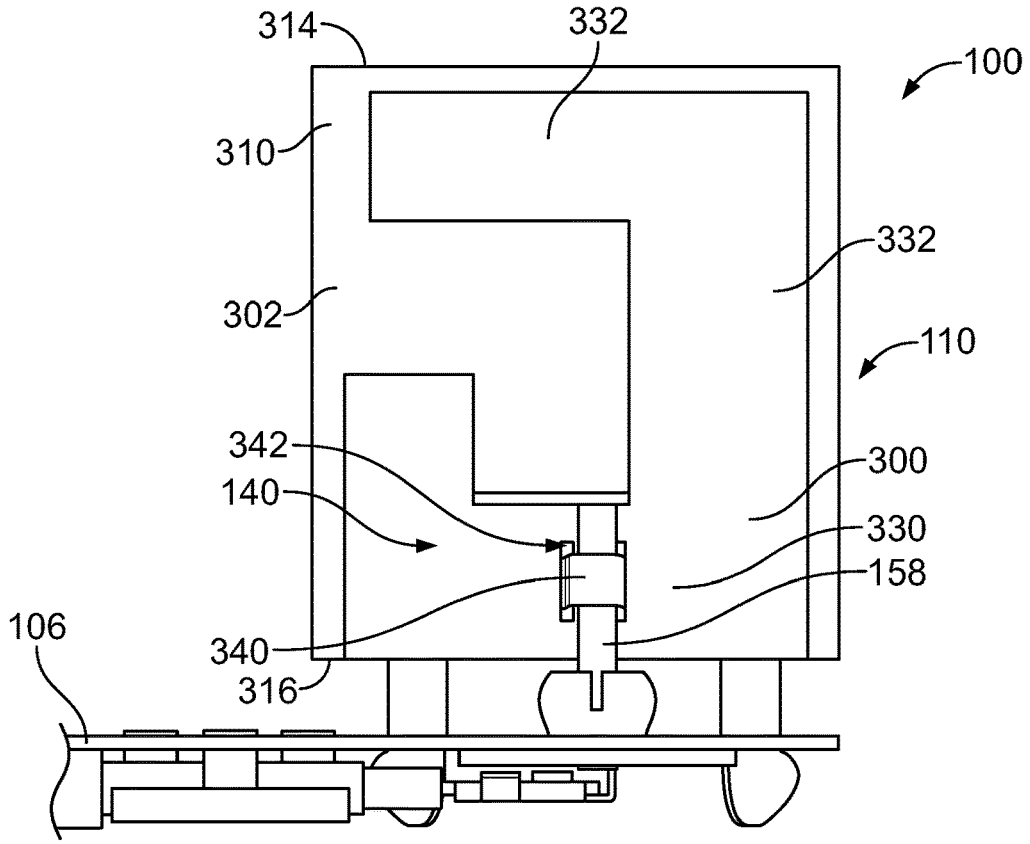
FIG. 14 is a front view of the monopole antenna assembly showing the monopole radiator in accordance with an exemplary embodiment.
Figure 15:
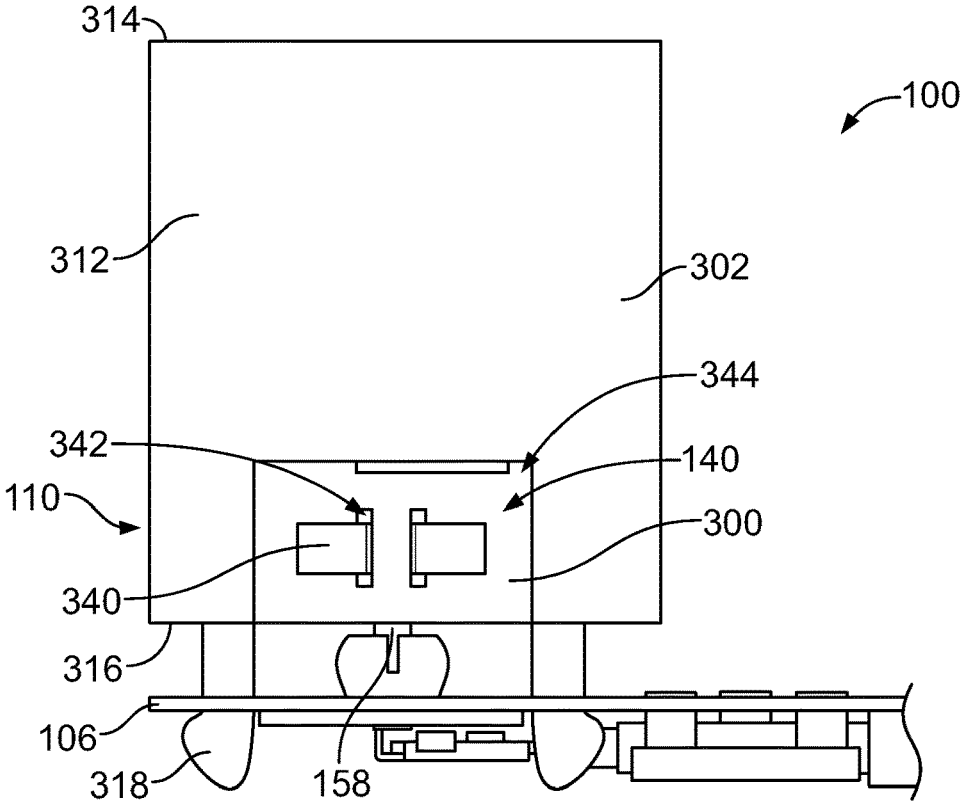
FIG. 15 is a rear view of the monopole antenna assembly showing the monopole radiator in accordance with an exemplary embodiment.

FIG. 12 is a perspective view of the monopole antenna assembly 100 showing the monopole radiator 110 in accordance with an exemplary embodiment. FIG. 13 is a side view of the monopole antenna assembly 100 showing the monopole radiator 110 in accordance with an exemplary embodiment. FIG. 14 is a front view of the monopole antenna assembly 100 showing the monopole radiator 110 in accordance with an exemplary embodiment. FIG. 15 is a rear view of the monopole antenna assembly 100 showing the monopole radiator 110 in accordance with an exemplary embodiment. The monopole antenna assembly 100 may be an omni-directional monopole rooftop antenna for multi-band applications in various embodiments. For example, the monopole antenna assembly 100 may be used for Wi-Fi, LTE, 5G or other frequency bands.

In the illustrated embodiment shown in FIGS. 12-15, the radiating element 140 of the monopole radiator 110 includes the pole 158 and a multi-band radiator panel 300. In the illustrated embodiment, the monopole radiator 110 is a multi-band antenna element. The pole 158 is electrically connected to the multi-band radiator element 300 at a solderless connection. The radiating element 140 may be assembled in a cost effective and reliable manner. The radiating element 140 may be assembled without hand soldering. The radiating element 140 may be assembled using an automated assembly process.

In an exemplary embodiment, the monopole antenna assembly 100 includes a radiator panel carrier 302 used to support the multi-band radiator element 300. The radiator panel carrier 302 is manufactured from a dielectric material, such as a plastic material. The radiator panel carrier 302 electrically isolates the multi-band radiator element 300 from the ground plane 106. In an exemplary embodiment, the radiator panel carrier 302 includes a front 310 and a rear 312 extending between a top 314 and a bottom 316. The multi-band radiator element 300 is coupled to the front 310. The pole 158 is located forward of the front 310. The bottom 316 faces the ground plane 106. Optionally, the radiator panel carrier 302 may include legs 318 extending from the bottom 316. The legs 318 are mounted to the ground plane 106 (or the ground plane holder 108. In various embodiments, the radiator panel carrier 302 may be oriented perpendicular to the ground plane 106. For example, the ground plane 106 may be oriented horizontally and the multi-band radiator element 300 may be oriented vertically.

In an exemplary embodiment, the multi-band radiator element 300 is a metal sheet or film coupled to the radiator panel carrier 302. For example, the multi-band radiator element 300 may be a stamped metal sheet. The multi-band radiator element 300 may be planar. For example, the front 310 of the radiator panel carrier 302 may be planar and the multi-band radiator element 300 may be flush with the front 310 of the radiator panel carrier 302. In alternative embodiments, the multi-band radiator element 300 may be a printed circuit, such as a rigid circuit board or a flex circuit. In various embodiments, the radiator panel carrier 302 may be formed from a rigid circuit board substrate and the multi-band radiator element 300 is defined by an antenna circuit on the substrate. In an exemplary embodiment, the multi-band radiator element 300 includes a main line 330 and one or more radiating branches 332 extending from the main line 330 in an antenna circuit pattern. The pattern of the antenna circuits affects the antenna characteristics, such as antenna frequencies of the multi-band monopole antenna assembly 100.

The pole 158 is coupled to the multi-band radiator element 300. In an exemplary embodiment, the pole 158 extends along a portion of the multi-band radiator element 300. In an exemplary embodiment, a clamp 340 is used to mechanically and electrically connect the pole 158 to the multi-band radiator element 300. The clamp 340 is secured to the multi-band radiator element 300 and/or the pole 158 at a solderless connection. The ends of the clamp 340 pass through openings 342 in the multi-band radiator element 300 and may be pulled or tightened to directly engage the pole 158 with the multi-band radiator element 300. The ends of the clamp 340 may be bent outward to secure the clamp 340 to the multi-band radiator element 300. The radiator panel carrier 302 includes an opening 344 that provides a space to access the clamp 340 to secure the clamp 340 to the multi-band radiator element 300. For example, the opening 344 provides a space for a tool to secure the clamp 340 to the multi-band radiator element 300. Other securing features may be used in alternative embodiments. For example, the multi-band radiator element 300 may include a crimp barrel configured to be crimped to the pole 158. Alternatively, the end of the pole 158 may be crimped to a tail or other feature of the multi-band radiator element 300. In other various embodiments, the pole 158 or the multi-band radiator element 300 may include a press-fit pin, such as a compliant pin configured to be press-fit into an opening in the other component.

Embodiments of monopole antenna assemblies are provided that may be assembled without the use of manual soldering. For example, connections between the cable and the monopole radiator, between the cable and the ground plane, between the directional reflector and the ground plane and the like are solderless connections. The solderless connections reduce manufacturing cost and increase manufacturing speed compared to soldered connections. The monopole antenna assembly is configured to be manufactured using automated processes to avoid human impact on quality of the electrical connections between the components. The monopole antenna assembly uses metal sheets rather than printed circuit boards to reduce electromagnetic wave loss typical of printed circuit boards (for example, due to the dielectric material of the substrates), which increase radiation efficiency, particularly in high frequency applications, such as applications above 5 GHz, such as V2X, Wi-Fi 6, 5G Ultra-Wide Band (UWB), remote keyless entry, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A monopole antenna assembly comprising:

a cable having a cable inner conductor and a cable outer conductor;

an antenna base including a ground plane, the ground plane being electrically connected to the cable outer conductor using a compression connection, the ground plane including an opening between an upper surface and a lower surface of the ground plane;

a monopole radiator having a radiating element and a cable connection element extending from the radiating element, the radiating element passing through the opening above the upper surface, the cable connection element being coupled to the cable inner conductor at a compression connection; and a monopole insulator coupled to the radiating element, the monopole insulator being received in the opening to isolate the monopole radiator from the ground plane, the monopole insulator including a flange coupled to the lower surface of the ground plane and a bulb extending from the flange through the opening in the ground plane, the bulb being spread outward above the ground plane over the upper surface of the ground plane to retain the monopole insulator on the ground plane, the bulb having a central bore, the radiating element passing through the bulb.

2. The monopole antenna assembly of claim 1, wherein the cable connection element includes a crimp element coupled to the cable inner conductor at a crimp connection.

3. The monopole antenna assembly of claim 1, wherein the compression connection of the cable connection element is a solderless connection and wherein the compression connection between the ground plane and the cable outer conductor is a solderless connection.

4. A monopole antenna assembly comprising:

a cable having a cable inner conductor and a cable outer conductor;

an antenna base including a ground plane, the ground plane being electrically connected to the cable outer conductor, the ground plane including an opening between an upper surface and a lower surface of the ground plane;

a monopole radiator having a radiating element and a crimp element extending from the radiating element, the radiating element passing through the opening above the upper surface, the crimp element located below the lower surface and being crimped to the cable inner conductor; and a monopole insulator coupled to the radiating element, the monopole insulator being received in the opening to isolate the monopole radiator from the ground plane.

5. The monopole antenna assembly of claim 4, wherein the radiating element is oriented perpendicular to the ground plane.

6. The monopole antenna assembly of claim 4, wherein the cable connection crimp element includes crimp tabs wrapped around the cable inner conductor and crimped to the cable inner conductor.

7. The monopole antenna assembly of claim 4, further comprising a ground lug having a main body coupled to the cable outer conductor and ground tabs extending from the main body, the ground tabs being coupled to the ground plane.

8. The monopole antenna assembly of claim 7, wherein the ground tabs are crimped to the ground plane.

9. The monopole antenna assembly of claim 7, wherein the ground plane and the cable outer conductor are compressed between the ground tabs and the main body.

10. The monopole antenna assembly of claim 4, further comprising a reflector coupled to the ground plane at a solderless connection, the reflector oriented perpendicular to the ground plane and being spaced apart from the radiating element.

11. The monopole antenna assembly of claim 10, wherein the reflector includes mounting tabs at a bottom of the reflector, the mounting tabs being coupled to the ground plane at a solderless connection.

12. The monopole antenna assembly of claim 11, wherein the mounting tabs are press-fit in openings in the ground plane.

13. The monopole antenna assembly of claim 4, wherein the radiating element includes a pole extending from the crimp element and a multi-band radiator panel, the pole being electrically connected to the multi-band radiator panel using a solderless connection.

14. The monopole antenna assembly of claim 13, further comprising a clamp mechanically and electrically connecting the pole to the multi-band radiator panel.

15. The monopole antenna assembly of claim 13, further comprising a radiator panel carrier supporting the multi-band radiator panel, the radiator panel carrier being coupled to the antenna base.

16. The monopole antenna assembly of claim 13, wherein the multi-band radiator panel is planar having multiple radiating branches.

17. The monopole antenna assembly of claim 4, wherein the monopole insulator includes a flange coupled to the lower surface of the ground plane and a bulb extending from the flange through the opening in the ground plane, the bulb being spread outward above the ground plane over the upper surface of the ground plane to retain the monopole insulator on the ground plane, the bulb having a central bore, the radiating element passing through the bulb.

18. The monopole antenna assembly of claim 4, wherein a connection between the crimp element and the cable inner conductor is a solderless connection and wherein a connection between the ground plane and the cable outer conductor is a solderless connection.

19. A monopole antenna assembly comprising:

a cable having a cable inner conductor and a cable outer conductor;

an antenna base including a ground plane, the ground plane being electrically connected to the cable outer conductor using a compression connection;

a monopole radiator having a radiating element and a cable connection element extending from the radiating element, the cable connection element being coupled to the cable inner conductor by a compression connection, the radiating element including a pole and a multi-band radiator panel, the pole extending from the cable connection element, the pole being electrically coupled to the multi-band radiator panel using a compression connection, the multi-band radiator panel being mounted to, and electrically isolated from, the ground plane.

20. The monopole antenna assembly of claim 19, further comprising a clamp mechanically and electrically connecting the pole to the multi-band radiator panel.

21. The monopole antenna assembly of claim 19, further comprising a radiator panel carrier supporting the multi-band radiator panel, the radiator panel carrier being coupled to the antenna base.

22. The monopole antenna assembly of claim 19, wherein the cable connection element includes a crimp element coupled to the cable inner conductor at a crimp connection.

23. The monopole antenna assembly of claim 19, wherein the compression connection of the cable connection element is a solderless connection and wherein the compression connection between the ground plane and the cable outer conductor is a solderless connection.

24. The monopole antenna assembly of claim 19, wherein the ground plane includes an opening between an upper surface and a lower surface of the ground plane, the radiating element passing through the opening above the upper surface, wherein a monopole insulator is coupled to the radiating element and passes through the opening to isolate the monopole radiator from the ground plane.

* * * * *